114-253 SR
7/22/80 OR 4,213,413

United States Patent [19]
Courtney

[11] 4,213,413
[45] Jul. 22, 1980

[54] WATER SKI TOW ASSEMBLY

[76] Inventor: Albert L. Courtney, Rte. #2, Lamar, Mo. 64759

[21] Appl. No.: 907,025

[22] Filed: May 17, 1978

[51] Int. Cl.[2] ..... B63B 21/56
[52] U.S. Cl. ..... 114/253; 24/128; 248/514; 280/480
[58] Field of Search ..... 114/251, 253, 254; 248/514, 538, 291; 403/173, 174, 92; 24/130, 128 R; 280/491 F, 480, 457; 244/1 TD

[56] References Cited

U.S. PATENT DOCUMENTS

| | | | |
|---|---|---|---|
| 2,667,317 | 1/1954 | Trebules | 248/514 |
| 3,132,878 | 5/1964 | De Puydt et al. | 280/480 X |
| 3,294,053 | 12/1966 | Emery, Jr. | 114/253 |
| 3,335,468 | 8/1967 | Harley | 24/128 R X |

FOREIGN PATENT DOCUMENTS

| | | | |
|---|---|---|---|
| 734723 | 5/1966 | Canada | 114/253 |

*Primary Examiner*—Sherman D. Basinger
*Attorney, Agent, or Firm*—John A. Hamilton

[57] ABSTRACT

A water ski tow assembly consisting of a semi-circular rail connected at its ends to a boat and extending rearwardly therefrom at variable angles of inclination from horizontal, a rolling carriage movable along the track, and a special rope hitch mounted on the carriage, the hitch permitting the attachment thereto of a plurality of tow ropes, and having provisions permitting quick attachment and detachment of ropes, locking the ropes against accidental detachment, and preventing entanglement of the ropes. The rail encircles the motor of the boat to prevent the ropes from becoming fouled in the propellor, protects the propellor from growing brush in the water, and insures the most desirable line of pull of the ropes relative to the boat.

2 Claims, 7 Drawing Figures

WATER SKI TOW ASSEMBLY

Figure 1:
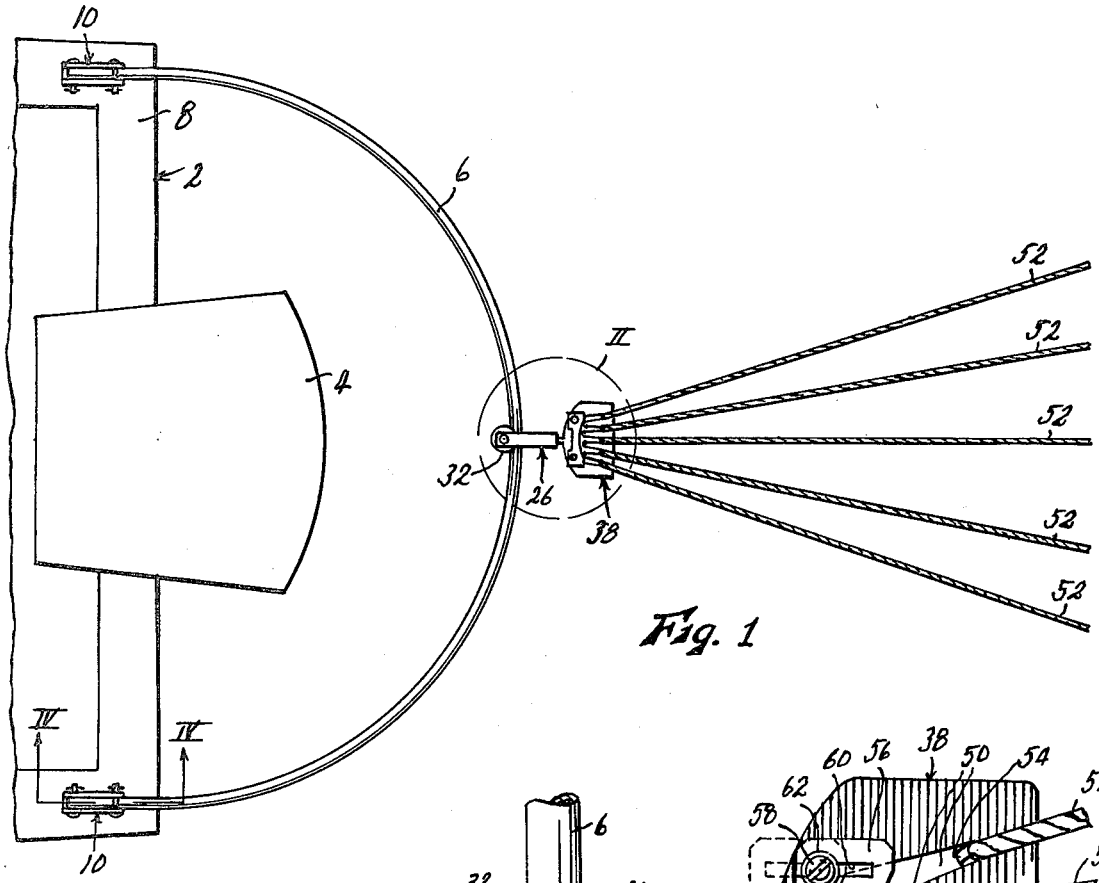

This invention relates to new and useful improvements in water ski towing assemblies, having particular reference to the means by which the water skier's tow ropes are connected to the towing boat.

An important object of the present invention is the provision of a towing assembly having means insuring the most desirable and safe line of pull of a tow line relative to the towing boat. The boat of course tilts laterally, or "banks", when negotiating a turn, so that one side thereof is higher than the other. If a tow rope is attached to a boat at the "high" side thereof in a turn, the pull of the tow rope may actually capsize the boat. This occurrence is not rare, and is of course highly dangerous. The likelihood thereof is of course increased with high boat speed and with the sharpness of the turn, when the skier himself is executing some maneuver which itself increases the tow line tension, and when a boat is towing a plurality of skiers, the pull on the boat of their tow ropes being cumulative. It has also occurred when the tow ropes of a plurality of skiers are connected to an upstanding mast disposed centrally of the rearward end of the boat, since the elevation of the mast provides a greater "lever arm" for the pull of the tow ropes. The present device insures that tow rope pull will always be at the "low" side of the boat, regardless of the direction of turn, so that the rope pull not only does not tend to capsize the boat by increasing its banking inclination, but actually fights the banking to reduce the degree thereof. Generally, this object is accomplished by the provision of a tow assembly comprising a semi-circular rail attached at its ends to the boat transom and projecting rearwardly therefrom, a rolling carriage mounted on and movable along said rail, and a rope hitch member mounted on said carriage, and to which one or more tow ropes may be connected. The rail, while extending rearwardly from the boat, may be adjustably pivoted upwardly to the rear, according to the normal riding attitude of the boat in the water, in order that the tow ropes may be maintained above water level. The rail may also horizontally encircle the boat motor, whereby to protect the propellor against becoming fouled in brush growing in the water, as when fishing, or by the tow ropes themselves when they are slack.

Another object is the provision of a novel rope hitch for mounting on the carriage. This hitch permits rapid, easy and selective engagement or disengagement of a plurality of tow ropes thereto, is swivelled on the carriage to reduce possible entanglement of a plurality of tow ropes, and has a manual locking device for preventing accidental disengagement of any tow rope. The carriage is also adapted for use with other standard rope hitches.

Other objects are simplicity and economy of construction, and efficiency and dependability of operation.

Figure 2:
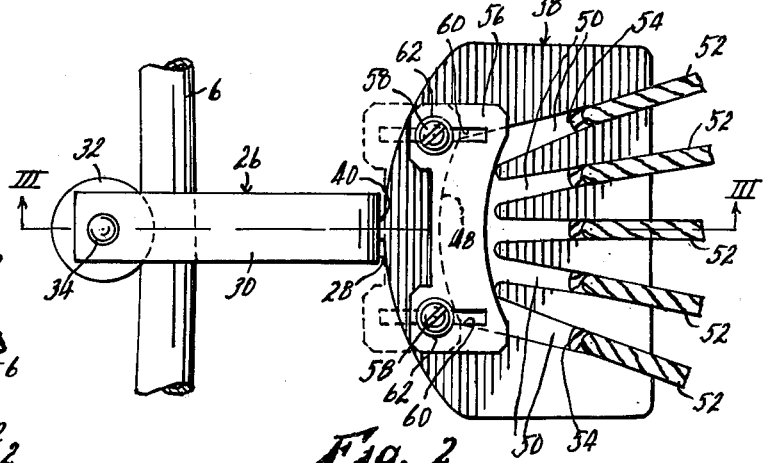
Figure 4:
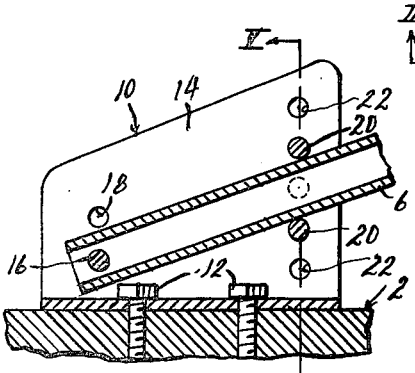
Figure 3:
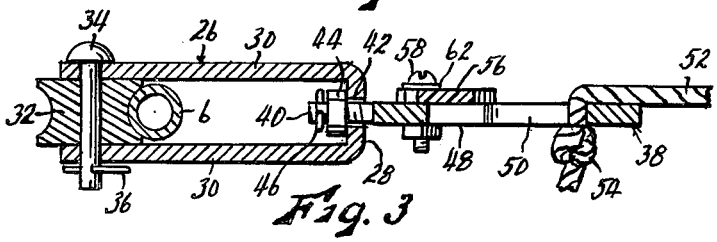
Figure 5:
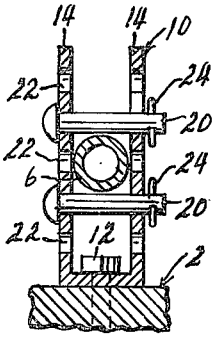
Figure 6:
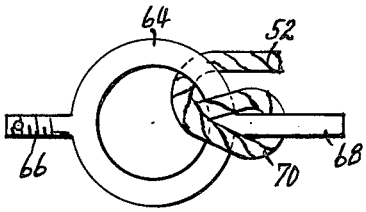
Figure 7:
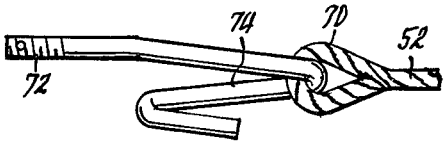

With these objects in view, as well as other objects which will appear in the course of the specification, reference will be had to the accompanying drawing, wherein:

FIG. 1 is a fragmentary top plan view of the rearward portion of a boat, with a water ski tow assembly embodying the present invention operatively mounted thereon, FIG. 2 is an enlarged, fragmentary view of that portion of the tow assembly included in circle II of FIG. 1, FIG. 3 is a sectional view taken on line III—III of FIG. 2, FIG. 4 is an enlarged, fragmentary sectional view taken on line IV—IV of FIG. 1, FIG. 5 is a sectional view taken on line V—V of FIG. 4, and FIGS. 6 and 7 are views of standard rope hitch devices which may also be utilized in the present assembly.

Like reference numerals apply to similar parts throughout the several views, and the numeral 2, in FIG. 1, applies to a power boat, only the extreme rear portion thereof being shown. The outboard motor of the boat is indicated at 4. An arcuate rail 6, which may be formed of tubular steel stock, and which is semicircular except for its extreme end portions, which are straight and parallel, is attached at each of its ends to the transom 8 of the boat by a bracket 10. As best shown in FIGS. 4 and 5, each bracket 10 is of a U-form, having its base affixed to transom 8 by screws or bolts 12 and having parallel upstanding side walls 14 spaced apart a slightly greater distance than the cross-sectional diameter of the rail. An end portion of the rail projects between said side walls, being pivoted at its extreme rearward end to said side walls by a transverse pin 16 insertable selectively through any of a plurality of vertically spaced apart matching holes 18 formed said side walls, and being normally secured against pivotal movement on pin 16 by being positioned, in horizontally spaced relation from pin 16, between a pair of transverse pins 20 inserted selectively through vertically spaced apart sets of matching holes 22 formed in said side walls. Pins 16 and 20 may be releasably secured by cotter keys 24, as indicated in FIG. 5. By properly selecting the holes in which the pins are inserted, rail 6 may be caused to project rearwardly from the boat at an upward inclination, as indicated in FIG. 4, such that the central portion of the rail will be disposed well above water level in any running attitude of the boat. Some boats ride in the water in a decidedly "nose-up" attitude.

Movable along rail 6 is a carriage 26. As best shown in FIGS. 2 and 3, said carriage comprises a U-shaped bracket having a base portion 28 and a pair of parallel legs 30 between the free end portions of which is mounted a roller 32 rotatable on axle pin 34 inserted through the bracket legs and releasably secured therein by cotter key 36. Said roller may be arcuately grooved to conform to the surface of the rail if desired.

Mounted on carriage 26 is a rope hitch member 38. As best shown in FIGS. 2 and 3, said hitch member consists of a flat metal plate having a threaded stem 40 projecting therefrom in its plane, extending rotatably through a hole 42 formed therefor in base 28 of bracket 26, and having a nut 44 threaded thereon within the bracket and secured by cotter key 46. Thus the hitch plate may rotate about the axis of stem 40 relative to carriage 26, the axis of rotation being at right angles to the axis of carriage roller 32.

Formed in the hitch plate is an aperture having an enlarged portion 48 disposed adjacent the side of said plate closest to stem 40, and a plurality of narrower finger slots 50, in this case five, opening into enlarged portion 48 and extending therefrom toward the opposite edge of the plate. As shown, the plate is adapted to have five tow ropes 52, which usually are formed of nylon, connected thereto, whereby the boat may tow five water skiers simultaneously, it being understood that the opposite end of each rope has a handle attached thereto which a skier may grasp to be towed. At hitch plate 38, a knot 54 is tied tightly in the end of each rope, and forms an enlargement thereof. The rope is engaged in the hitch plate by inserting knot 54 thereof through enlarged portion 48 of the plate aperture, which is large enough to pass said knot therethrough, and the rope then moved into one of narrow slots 50 of said aperture, which are large enough to receive the rope, but not to pass the knot. No amount of rearward pulling force on the rope, up to and including the breaking strength of the rope, can disengage it from the hitch plate, although it may easily be detached by slackening it and moving it into enlarged aperture portion 48.

Accidental disengagement of the tow ropes from the hitch plate, as could occur when the ropes are slack, is prevented by a lock plate 58 held flat against hitch plate 38 and frictionally slidable thereagainst. It may be formed of plastic, as indicated in FIG. 3, to provide better frictional contact with the hitch plate, and is secured thereto by a pair of bolts 58 which engage in parallel slots 60 of the lock plate to permit movement of the latter. Each bolt may also be provided with a friction washer 62. In the position of the lock plate shown in solid lines in FIG. 2, it overlies and obstructs the enlarged portion 48 of the hitch plate aperture, so as to prevent the movement of any tow rope 52 thereinto, and the passage of any rope knot 54 therethrough. When the lock plate is moved to the position shown in dotted lines, however, it completely uncovers enlarged portion 48 of the plate aperture, and ropes 52 may be attached to and detached from the hitch plate at will. It will of course be understood that all edges of hitch plate 38 with which ropes 52 come in contact may be rounded to prevent any tendency thereof to cut the ropes.

Operation of the tow assembly is believed obvious. In use, it will be seen that if boat 2 enters a turn and "banks" laterally, carriage 26 will roll along rail 6 toward the "inside" of the boat turn, since the line of tow rope pull relative to the boat shifts, in that direction, and the carriage rolls freely on the rail. Thus the tow rope pull is always at the "low" side of the boat with respect to lateral tilt of the boat in its banking turn. As a result, the tow rope pull cannot tend to accentuate or increase the banking inclination of the boat, and in extreme cases actually capsize the boat, but on the contrary will actually tend to combat such banking inclination, so as to reduce the lateral tilting and cause the boat to ride more nearly level.

The upward and rearward inclination of rail 6, as previously described and as provided by adjustment of brackets 10, may be necessary in some cases to maintain hitch plate 38 and the adjacent portions of ropes 52 above water level. The rail could be inclined upwardly to the rear to a very substantial degree, even in the running attitude of the boat, without interfering with the movement of carriage 26 along said rail as just described. It will be noted also, as shown in FIG. 1, that rail 6 encircles boat motor 4. In ski towing, this tends to hold the tow ropes 52 well clear of the propellor disposed below and driven by the motor, so that they do not become fouled in the propellor. If a boat so equipped is used for fishing, the rail acts as a brush guard tending to prevent fouling of the propellor by marine vegetation.

The preferred hitch plate 38 has several advantages. A plurality of tow ropes 52, five as shown although the specific number is not material, may be selectively attached thereto or detached therefrom in any sequence, without interference therebetween, and lock plate 56 prevents accidental disengagement. However, types of hitch members other than plate 38 could also be used, for example such as shown in FIGS. 6 and 7. The hitch in FIG. 6 consists of a heavy metal ring 64 having an integral stem 66 corresponding in all respects to stem 40 of plate 38 extending radially therefrom, and an integral peg 68 extending therefrom oppositely to stem 66. For this hitch, the end of tow rope 52 has an eye 70 formed therein. To attach it, the eye 70 is threaded through ring 64, then engaged over peg 68, as shown. The hitch shown in FIG. 7 comprises a single length of rod stock having one end thereof forming a stem 72 identical to stems 66 and 40, and the remainder of its length formed in an open helical coil 74, viewed transversely to its axis in FIG. 7, of at least greater than one full turn. The eye 70 of a tow rope 52 is engaged therein by engaging eye 70 over the free end of the rod, and moving it therealong to engage the point thereof opposite from stem 72, as shown.

While I have shown and described certain specific embodiments of my invention, it will be readily apparent that many minor changes of structure and operation could be made without departing from the spirit of the invention.

What I claim as new and desire to protect by Letters Patent is:

1. A water ski tow assembly comprising:

a. a generally semi-circular rail, b. means for attaching the ends of said rail to the rearward portion of a tow boat to project rearwardly from the stern of said boat, c. a carriage mounted on said rail for rolling movement therealong, d. a rope hitch member mounted on said carriage and to which one end of a tow rope may be connected, said tow rope having an enlargement affixed to the end thereof to be attached to said hitch member, and said hitch member comprising a flat plate having an aperture formed therethrough, said aperture being elongated in a direction generally radial to said rail, the end portion of said aperture closest to said rail being sufficiently wide to pass said rope and said rope enlargement therethrough, and the end portion thereof remote from said rail being sufficiently narrow to admit said rope but not said enlargement, and e. a locking device consisting of a lock plate having at least one elongated slot, and a fastener engaged in said slot and said hitch plate for movably mounting said locking device on said hitch plate, said locking device being manually movable between positions in which it respectively does and does not overlie the wider end portion of said hitch plate aperture.

2. An assembly as recited in claim 1 in which said hitch plate aperture includes a plurality of said narrower portions, all interconnected with the wider portion thereof closest to said rail, and projecting therefrom in a direction away from said rail, whereby a plurality of tow ropes may be individually and separately connected to said hitch plate, each in one of said narrower aperture portions, and all secured therein by said lock plate.

* * * * *